United States Patent [19]

Cooper

[11] 4,007,933

[45] Feb. 15, 1977

[54] TIMING GAME

[75] Inventor: Julius Cooper, New Hyde Park, N.Y.

[73] Assignee: Ideal Toy Corporation, Hollis, N.Y.

[22] Filed: Oct. 20, 1975

[21] Appl. No.: 623,839

[52] U.S. Cl. ..... 273/86 C; 273/1 R

[51] Int. Cl.[2] ..... A63F 9/14

[58] Field of Search ..... 273/86 C, 1 R

[56] References Cited

UNITED STATES PATENTS

| | | | |
|---|---|---|---|
| 2,853,301 | 9/1958 | Glass | 273/86 C |
| 3,502,332 | 3/1970 | Wolf | 273/86 C |
| 3,711,094 | 1/1973 | Coffman | 273/86 C |
| 3,787,050 | 1/1974 | Goldfarb | 273/1 R |
| 3,883,137 | 5/1975 | Bengston | 273/86 C X |

*Primary Examiner*—Anton O. Oechsle

*Attorney, Agent, or Firm*—Richard M. Rabkin

[57] ABSTRACT

The game consists of a frame having a plurality of ramps, directed towards a central common station or well, along which balls are rolled in a simulated race to discharge a scoring chute connected to the common central station; the sequence in which the balls enter the scoring chute determines a score for each player. In one embodiment of the invention a marker ball is deposited at the central station, independently of the game balls rolling along the ramps, so that it also enters the discharge chute. The marker ball is used to differentiate between game balls which enter the discharge chute before and after the marker ball. Those balls entering the chute before the marker ball obtain "plus" scores while those entering the discharge chute after the marker ball obtain "minus" scores.

23 Claims, 6 Drawing Figures

TIMING GAME

The present invention relates to a game structure and in particular to a game in which a race is played among the several players by the use of game balls projected along a game frame.

It is an object of the present invention to provide a game in which players compete against each other, and against a timer or marker ball, by using a combination of timing skill and manual dexterity in order to "beat" the timer ball to a designated scoring area.

Another object of the present invention is to provide an amusement game permitting competition among several players.

A further object of the present invention is to provide a game in which game balls can be raced against one another and against a marker or timer ball to a designated score area.

A still further object of the present invention is to provide a game which is durable in use and relatively inexpensive to manufacture.

In the game of the present invention a frame is provided having a plurality of game ball guide ramps feeding to a common central station or well. A scoring or discharge chute extends from this central station and is constructed to direct game balls converging at the central station into the chute. The game balls are selectively released by a relatively simple trigger mechanism under the manual control of the respective players, so that the balls are allowed to roll by gravity to the central station and into the scoring chute. The order in which the balls enter the scoring chute controls the score achieved by the respective players.

In accordance with a feature of the invention, a marker or timing ball is deposited at the central station independently of the release of the game balls down their guide ramps. This is accomplished by the use of a funnel or the like mounted above the central station, having its lower open neck located directly above the well. One of the players, in the play of the game, deposits the marker ball in the funnel, as for example by spinning the ball along the upper edge thereof, so that the marker ball acts as a vortex timing mechanism. The players must time the fall of the marker ball into the common station and release their game ball in sufficient time to allow their game balls to enter the common station and scoring chute before the marker ball.

Indicia are provided on the scoring chute indicating the score of the balls entering the chute, and the indicia is arranged such that the first ball entering the chute achieves the lowest "plus" score, with successive balls obtaining higher scores. However, balls entering the scoring chute after the marker ball achieve "minus" scores, with the lowest negative score being applied for the game ball closest the marker ball and higher negative scores for those successively entering the discharge chute. In this manner, the players must time the release of their game balls in order to attempt to have their game ball enter the discharge chute just before the marker ball. Thus the game ball entering the chute immediately before the marker ball will obtain the highest "plus" score. The game requires a degree of manual dexterity and aptitude for timing the drop of the marker ball into the common station and the relative speed of the player's game ball along its inclined ramp to the common station and scoring chute.

The above, and other objects, features and advantages of the present invention will be apparent in the following detailed description of an illustrative embodiment thereof, which is to be read in conjunction with the accompanying drawings, wherein.

Figure 1:
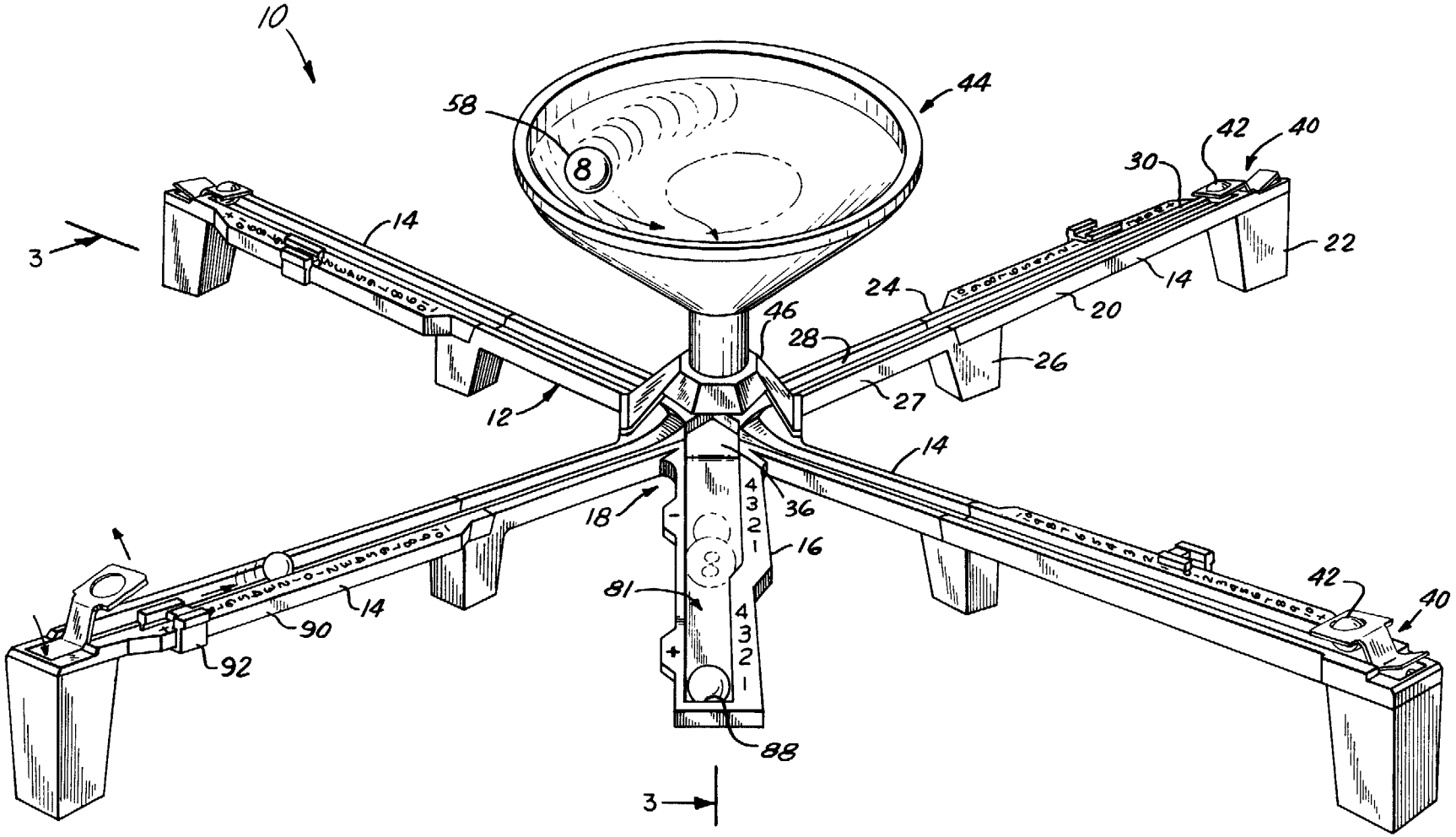
FIG. 1 is a perspective view of a game constructed in accordance with one embodiment of the present invention.
Figure 3:
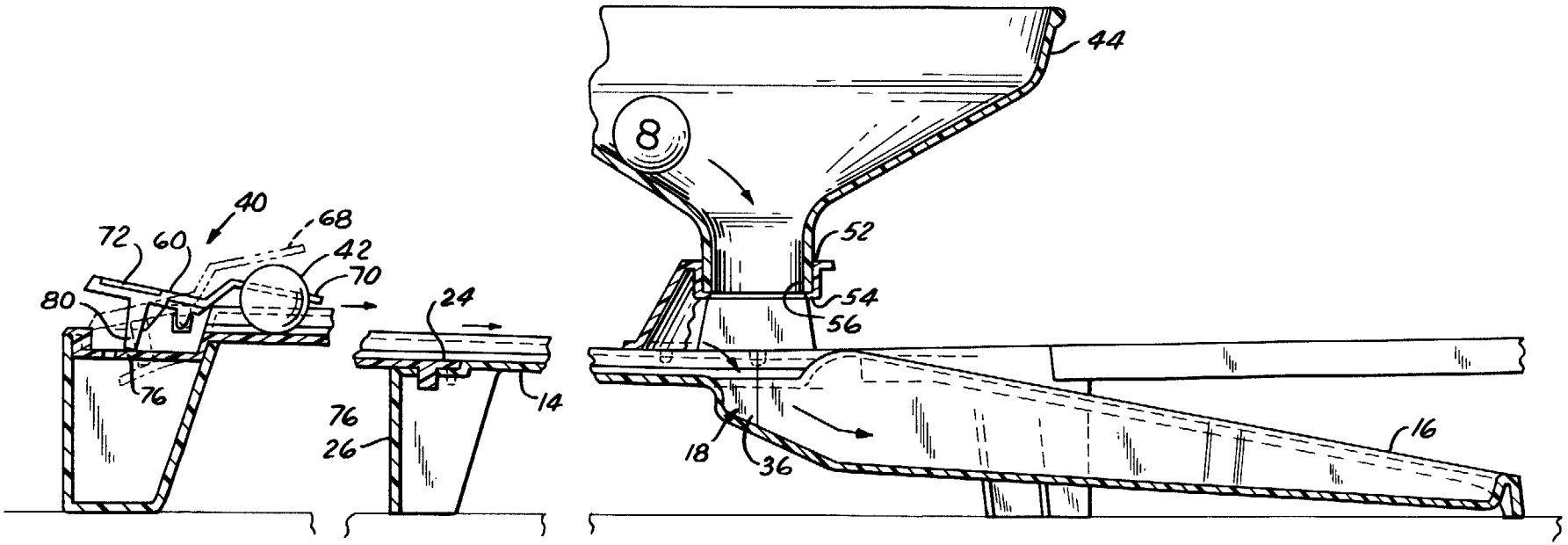
FIG. 3 is a sectional view taken along the angled line 3—3 in FIG. 1, with parts of the game being broken away for clarity.

Referring now to the drawing in detail, and initially to FIG. 1 thereof, it will be seen that the game 10 includes a molded plastic main frame 12 having a plurality of downwardly inclined ramps 14 and a discharge or scoring chute 16 formed therewith, extending from a central common station or well 18. The ramps 14 incline downwardly towards station 18 and may be integrally formed as one piece members, or they can be formed in sections in any convenient manner. For example, in the illustrative embodiment of the invention, each of the ramps 14 consists of a first ramp portion 20 having a support leg 22 at its outer end and resting at its inner end 24 on a support leg 26 of frame 12. The inner end 24 of the ramp portion 20 can be snap fit into the upper end of frame support 26 in any convenient manner, as for example as illustrated in FIG. 3, so that ramp portion 20 forms an extension of the integral inner ramp portion 27 of frame 12.

Figures 2, 6:
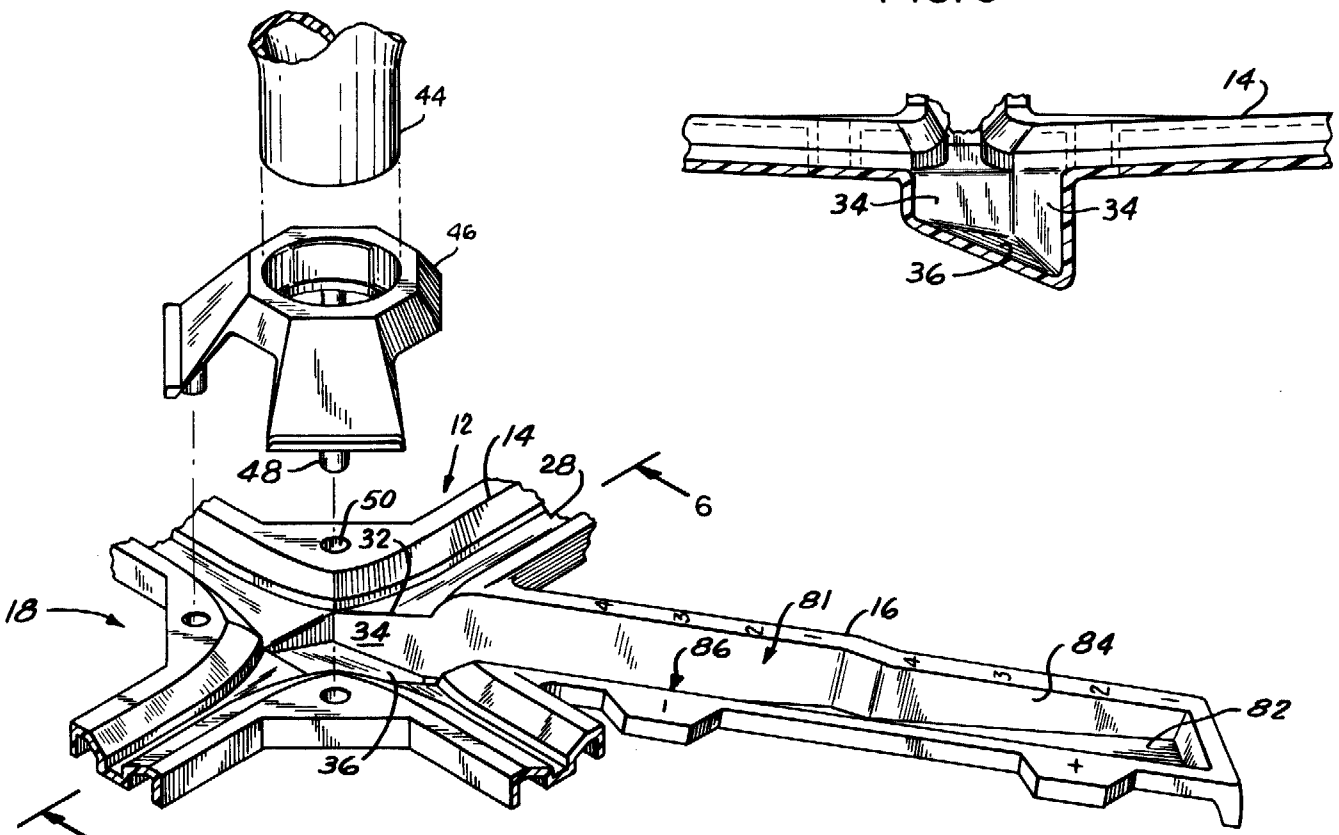
FIG. 2 is a partial exploded perspective view of the central station and discharge chute used in the game illustrated in FIG. 1.
FIG. 6 is a sectional view of the central station of the game, taken along line 6—6 of FIG. 2.

In any event, each ramp each defines an upwardly opening channel 28 leading from the outer end 30 of the ramp downwardly towards the central or common station 18. As illustrated in FIG. 2, the inner ends 32 of ramps 14 terminate in end walls 34 which define a central well 36 at station 18. This well communicates directly with the scoring chute 16 which is inclined, as seen in FIG. 6, so that game balls rolling from ramps 14 and falling into well 36 are directed into the scoring chute 16.

A trigger mechanism 40 is provided at the outer end 30 of each of the ramps 14. These trigger mechanisms releasably engage game balls 42 that are respectively associated with each of the ramps 14. Preferably, each of the game balls is of a different color, so as to be readily identified by and associated with the respective players. By manually operating the trigger mechanisms 40, as described hereinafter, game balls 42 are released by the players for rolling movement, under the influence of gravity, down ramps 14 into well 36 and thus into the discharge or scoring chute 16.

A funnel 44 is mounted at the central or common station 18 to allow the players, in accordance with the rules of the game, to deposit the marker or timing ball 58 into the game. The funnel 44 is mounted on a tripod base 46 which, as seen in FIGS. 2 and 3, is removably mounted by pegs 48 in apertures 50 formed in frame 12. The tripod has a cylindrical opening 52 defining a shoulder 54 on which the lower open end or neck 56 of the funnel is seated. By this arrangement a player can drop the marker ball 58 into the funnel and thus into the central station 18. This can be done simply by directly dropping the ball through the neck 56 of the funnel or by spinning the ball about the upper end of the funnel, thereby delaying the dropping of the ball into the well 36 for the time period taken by the ball to circulate through the funnel, in the manner of a vortex timer.

Once marker ball 58 drops into well 36, it is directed to the discharge chute 16 in the same manner as game balls 42. Thus, as described more fully hereinafter, in the play of the game the players watch the marker ball as one of the players deposits it in the funnel 44. They time the release of their game balls 42 with the position of the marker ball and the manner in which it has been dropped into the funnel, so as to try and have their game balls enter well 36 and scoring chute 16 before the marker ball. If they are successful their game balls will win game points for the players; if they are not successful and their game balls enter the discharge chute after the marker ball (as shown in dotted lines in FIG. 1) then points are subtracted from the players' scores.

Preferably the marker ball has indicia thereon which distinguishes it from game balls 42, e.g. the marker ball can be provided as an "eight ball". Additionally the marker ball has a larger diameter than the game balls.

Figure 4:
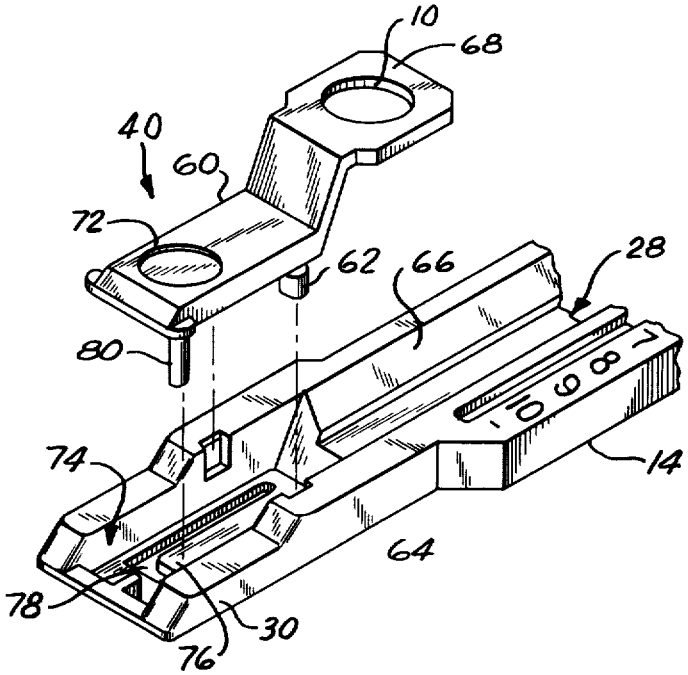
FIG. 4 is an exploded perspective view of the trigger mechanism used in the game of FIG. 1.

Trigger mechanism 40 is shown in detail in FIG. 4. As seen therein the trigger consists of a lever 60 which is pivotally mounted in any convenient manner, as for example by laterally extending pins 62 seated in slots 64 formed in the side walls 66 of the channel 28 defined in ramps 14. The opposite ends of the lever are slightly offset from one another with the innermost end 68 having an opening 70 therein which is adapted to accommodate a portion of a game ball 42 in order to hold the ball in place in channel 28. The rear portion 72 of the lever is slightly offset from the forward end 68 and is received in a recess 74 formed in the base of channel 28. This recess has a leaf spring 76 formed therein, as for example by forming the plastic channel with a U-shaped cutout 78 defining the tongue or leaf spring 76, with the latter engaging a stem 80 on the lower side of lever end 72. By this arrangement, as seen in FIG. 3, leaf spring 76 maintains lever 60 in the solid line position (FIG. 3) wherein game ball 42 is trapped in a fixed position against movement down ramp 14. In order to release the trigger mechanism the rear end 72 of the lever is manually depressed against the bias of leaf spring 76 in order to raise the forward end 68 of the lever and remove aperture 70 from about game ball 42. Thus the ball is free to roll down inclined ramp 14 into the well 36 and scoring chute 16.

Figure 5:
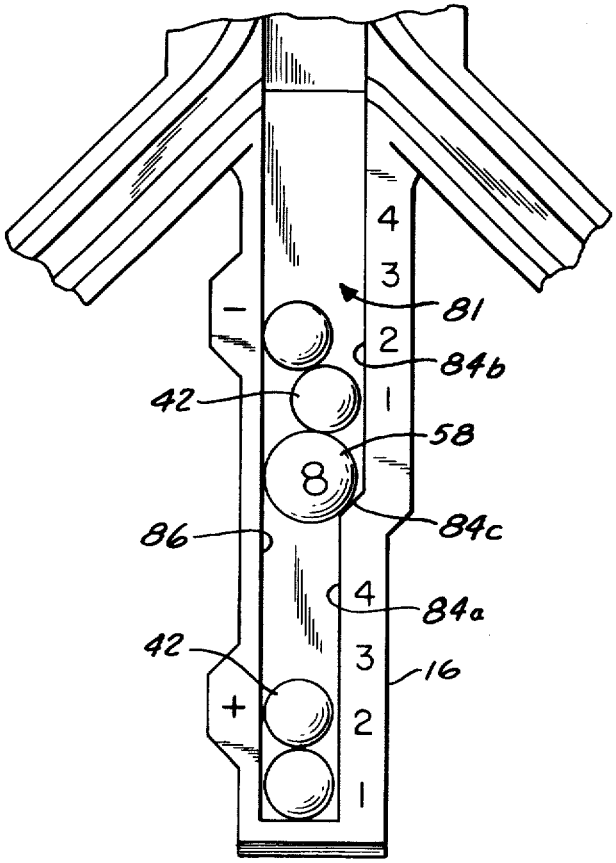
FIG. 5 is a plan view of the discharge chute and scoring indicia thereon.

The scoring chute is formed as an upwardly opening channel 81 having a base 82 and a pair of side walls 84, 86. The latter is relatively straight, as seen in FIG. 5, whereas side wall 84 is divided into two offset sections **84*a* and 84*b*, interconnected by an inclined ramp segment 84. Wall sections 84*a* and 84*b* are parallel to wall 86, but wall 84*a*, at the lower end portion of chute 16, is more closely spaced from wall 86 than wall 84*b*. This spacing is selected such that the distance between wall 86 and wall portion 84*a* is approximately equal to the diameter of a game ball 42. On the other hand, the larger spacing between wall 86 and wall portion 84*b* is selected to be approximately equal to the larger diameter of the marker ball 58. In this manner when marker ball 58 enters scoring chute 16 it will be stopped by the inclined segment 84*c* of the chute side wall, so as to block passage of any further game balls 42** into the lower end of the scoring chute. This feature of the invention allows a unique scoring system to be utilized during the play of the game.

More specifically, as seen in FIG. 5, scoring chute 16, along wall portion **84*a*, is provided with indicia (the numerals 1–4) representative of "plus" scores for the players. The indicia are spaced from one another a distance approximately equal to the diameter of a game ball, such that when the first game ball enters chute 16 and rolls to the end of the chute, where it is stopped by the vertical end wall 88, the center of the ball is located approximately adjacent the numeral 1. Similarly, as seen in FIG. 5, the second game ball down the chute will be stopped adjacent the numeral 2. Thus the player whose ball first enters chute 16 is awarded a game score of 1 and the second player is awarded a game score of 2, etc. However, these game balls must enter chute 16 before the marker or timing ball 58**.

Once marker ball 58 enters the scoring chute no further "plus" scores can be obtained. Any balls entering the chute after the marker ball 58 will be stopped in the upper portion of the scoring chute along wall portion **84*b*. At that portion of the scoring chute indicia are provided representative of "minus" scores. In the illustrative embodiment minus scores are also represented by the numerals 1–4. These numerals are located with respect to the inclined wall portion 84*b* such that when the marker ball 58 is in position adjacent wall portion 84*c* the next game ball entering the discharge chute will be stopped with its center located adjacent the numeral 1** and succeeding balls will be located with their centers adjacent their associated score numeral. Thus players who do not succeed in getting their game balls into the discharge chute before the marker balls will lose points from their total score.

In order to aid the players in keeping track of their scores, each of the ramps 14 is provided with a laterally extending flange 90 on which plus and minus scoring indicia are provided represented by the numerals (+) and (−) 1-10. An indicator member 92 is slidably mounted on flange 90, in any convenient manner, so as to move along the flange member and align with a numeral representative of the player's score at a particular instant in time.

In the play of the game the players each select one of the differentiated colored game balls and place it in the release trigger 40 for their associated ramp. One of the players is chosen to drop the marker ball into funnel 44. The chosen player releases the marker ball adjacent the rim of the funnel and can either drop the ball straight down the funnel or, by a flick of the wrist, send the ball spinning about the funnel in a vortex type path. Once the marker ball is released, each player can then release his own game ball at the last possible moment at which he feels it will beat the marker ball down the scoring or discharge chute 16. The player must time the release of his game ball such that it will enter the scoring chute just prior to the marker ball so that he can gain the optimum possible score. In order to release their game balls, the players simply press down on the rear end 72 of their trigger release mechanisms 40 and hold the levers down while the ball rolls from below the inner end 68 of the trigger lever. A player releasing his game ball prior to the release of the marker ball can be penalized a given number of points, e.g. 4 points.

After all of the game balls and the marker ball are released, they naturally gravitate to the central station 36 and thence into the scoring chute. Those balls which enter the scoring chute before the marker ball earn game points in accordance with the sequence in which they enter the chute, i.e. the first ball in earns 1 point, the second 2 points, the third 3 points, etc. However, once the marker ball enters the scoring chute, passage of any further game balls into the "plus" score end of the chute is prevented. Thus any balls entering the chute after the marker ball will be trapped in the "minus" end portion of the chute, and earn minus points in the order in which they enter the chute. Thus the first ball into the scoring chute after marker ball earns minus 1 point, the second earns minus 2 points, etc. Accordingly it is advantageous to the players to try and have their game balls enter the discharge chute at approximately the same time as the marker ball (and obviously preferably slightly ahead of the marker ball) so that they will earn a maximum of plus points, or at most lose a minimum number of minus points.

After the marker ball and all of the game balls have entered the scoring chute, each player calculates his own score and registers that score by sliding his slide indicator 92 to the appropriate number.

In the play of the game the players select any predetermined goal as being indicative of the winner of the game. In one such game the players can decide for example that after three rounds of releasing game balls into the scoring chute, the player with the highest score wins. Alternatively, the play of the game can continue until one player achieves a predetermined score, such as for example plus 10.

Accordingly, it will be appreciated that a relatively simple yet inexpensively constructed game is provided which requires the use of manual dexterity as well as mental perceptiveness and time aptitude on the part of the players. The game is rapid and exciting, in that not only are the players competing against each other to achieve a maximum possible score during each individual play, but they are also competing against a relatively indeterminate factor, namely the amount of time it will take for the marker ball to enter the central common station and scoring chute. Thus an added factor of excitement and probability enter the game and add to its enjoyment.

Although an illustrative embodiment of the present invention has been described herein with reference to the accompanying drawings, it is to be understood that the invention is not limited to that precise embodiment, but that various changes and modifications may be effected therein by one skilled in the art without departing from the scope or spirit of this invention.

What is claimed is:

1. A game comprising, a frame including a plurality of ramps directed towards a central common station and a discharge chute located below and in communication with said common station; a plurality of game balls respectively associated with said ramps for movement therealong to said common station and into said discharge chute; said ramps each having a first end portion located adjacent said common station and a second end portion remote from said first end portion and at a higher elevation than said first end portion whereby said balls will roll down the ramps to said common station and into said discharge chute, said chute having a first end adjacent said common station and a second end remote from and at a lower elevation than its first end whereby said balls will roll down the discharge chute towards its second end in the sequence in which they arrive at said common station; a marker ball, and means located above said common station and the first end portion of said ramps and chute for allowing deposit of said marker ball into the common station from a position above the common station and said first end portions of the ramps and chute independently of said ramps.

2. The game as defined in claim 1 wherein said marker ball has indicia thereon differentiating the marker ball from the balls associated with said ramps.

3. A game comprising a frame including a plurality of ramps directed towards a central common station and a discharge chute located in communication with said common station; a plurality of game balls respectively associated with said ramps for movement therealong to said common station and into said discharge chute; said ramps each having a first end adjacent said common station and a second end remote from said first end and at a higher elevation than said first end whereby said balls will roll down the ramps to said common station and into said discharge chute; said chute having a first end adjacent said common station and a second end remote from and at a lower elevation than its first end whereby said balls will roll down the discharge chute towards its second end in the sequence at which they arrive at said common station; a marker ball, and means at said common station for allowing deposit of said marker ball at the common station independently of said ramps; said chute including an upwardly opening channel having a first portion adjacent the second, lower end of the chute having a width dimension approximately equal to the diameter of said game balls and a second portion adjacent the first, upper end of the chute having a width dimension which is greater than the width dimension of said first portion, said marker ball having a diameter which is greater than the diameter of said game balls and approximately of the same dimensions as the width of said second chute portion whereby the marker ball will prevent game balls entering the chute after the marker ball from passing into the first portion of the chute.

4. The game as defined in claim 3 wherein said means at the common station comprises an upwardly opening funnel mounted above the common station and having a discharge and located directly above said common station.

5. The game as defined in claim 3 including means on each of said ramps for retaining a game ball thereon and for selectively releasing the game ball for rolling movement down the ramp.

6. The game as defined in claim 5 wherein each of said retaining and releasing means comprises a lever pivotally mounted on its associated ramp intermediate its ends, said lever having an opening in the end thereof closest to said common station for engaging a portion of a game ball; and resilient means biasing the lever into engagement with the game ball to trap the game ball between the lever and the ramp.

7. The game as defined in claim 3 wherein said marker ball has indicia thereon differentiating the marker ball from the balls associated with said ramps.

8. A game comprising a frame including a plurality of ramps directed towards a central common station and a discharge chute located in communication with said common station; and a plurality of game balls respectively associated with said ramps for movement therealong to said common station and into said discharge chute; said ramps each having a first end portion adjacent said common station and a second end portion remote from said first portion and at a higher elevation than said first end portion whereby said balls will roll down the ramps to said common station and into said discharge chute, said chute having a first end adjacent said common station and a second end remote from and at a lower elevation than its first end whereby said balls will roll down the discharge chute towards its second end in the sequence at which they arrive at said common station; a marker ball, means at said common station for allowing deposit of said marker ball into the common station independently of said ramps; and means on each of said ramps for retaining a game ball thereon and for selectively releasing the game ball for rolling movement down the ramp; said retaining and releasing means comprising a lever pivotally mounted on its associated ramp intermediate its ends, said lever having an opening in one end thereof closest to said common station for engaging a portion of a game ball; and a leaf spring integrally formed with said ramp and operatively engaged with said lever for biasing the lever into engagement with the game ball to trap the game ball between the lever and the ramp.

9. A game comprising a frame including a plurality of inclined ramps directed toward a common central station and a discharge chute located in communication with said common station, said ramps each being inclined generally downwardly from a first end portion thereof to a second end portion adjacent said common station and said chute being inclined downwardly from a first end portion adjacent said common station to a second end portion; a plurality of game balls respectively associated with said ramps for movement therealong to said common station and into said chute; a marker ball, and means on said frame above said common station and said first end portions of said chute and ramps for allowing deposit of said marker ball into the common station from a position above the common station and said first end portions of said chutes and ramps for movement into said chute independently of said ramps.

10. The game as defined in claim 9 including means on each of said ramps for retaining a game ball thereon and for selectively releasing the game ball for rolling movement down the ramp.

11. The game as defined in claim 10 wherein said frame has a well formed therein at said common station including a lower surface located below the level of the ramps at the common station and inclined downwardly towards said first end of the chute whereby game balls fall off said second ends of the ramps into said well and are directed by said lower surface of the well to said discharge chute.

12. The game as defined in claim 10 wherein said marker ball has indicia thereon differentiating the marker ball from the balls associated with said ramps and when deposited at said common station, is directed by the lower surface of the well to said discharge chute.

13. The game as defined in claim 10 wherein said marker ball has indicia thereon differentiating the marker ball from the balls associated with said ramps.

14. The game as defined in claim 9 wherein said means at the common station comprises an upwardly opening funnel mounted above the common station and having a discharge located directly above said common station.

15. The game as defined in claim 9 wherein said marker ball has a diameter which is different than the diameter of said game balls and said chute includes means located at a predetermined position in the chute for cooperating with said marker ball to prevent game balls entering the chute after the marker ball from passing said predetermined position in the chute.

16. A game as defined in claim 15 wherein said marker ball has a larger diameter than said game ball.

17. A game as defined in claim 16 wherein said chute has a passage formed therein for said balls and said means comprises a passage section dimensioned to prevent passage of the marker ball.

18. A game comprising a frame including a plurality of inclined ramps directed toward a common central station and a discharge chute located in communication with said common station, said ramps each being inclined generally downwardly from a first end portion thereof to a second end portion adjacent said common station and said chute being inclined downwardly from a first end portion adjacent said common station to a second end portion; a plurality of game balls respectively associated with said ramps for movement therealong to said common station and into said chute; a marker ball, and means at said common station for allowing deposit of said marker ball at the common station for movement into said chute independently of said ramps; said chute comprising an upwardly opening channel located in direct communication with said common station to receive balls therefrom, said channel including a bottom and a pair of spaced side walls, said side walls, in a first portion of the chute, adjacent the second lower end thereof being spaced a distance which is substantially equal to the diameter of said game balls, and, in a second portion of the chute, adjacent the first, upper end portion thereof, the side walls are spaced apart a distance which is greater than their spacing in said first portion; at least one of said side walls including an inclined connecting section to accommodate the change in wall spacing between said chute portions; said marker ball having a diameter greater than the diameter of said game balls and approximately the same dimension as the wall spacing in said second chute portion, whereby the marker ball will prevent game balls, entering the chute after the marker ball, from passing into the first portion of the chute.

19. The game as defined in claim 18 wherein said first and second chute portions have predetermined lengths and said chute has scoring indicia associated therewith along said first and second chute portions, said scoring indicia comprising, in the first portion of the chute, a series of scoring numbers spaced from each other a distance substantially equal to the diameter of a game ball with first scoring number of the series located adjacent the second end of the chute at which the first game ball entering the chute comes to rest, and, in the second chute portion, a series of scoring numbers also spaced from each other a distance substantially equal to the diameter of a game ball, with the first scoring number of this series located adjacent to said inclined connecting section of the chute side wall at the position in which a game ball, moving down the chute immediately after the marker ball, will be stopped by the marker ball blocking the first portion of the chute.

20. The game as defined in claim 19 wherein said means at the common station comprises an upwardly opening funnel mounted above the common station and having a discharge located directly above said common station.

21. The game as defined in claim 19 including means on each of said ramps for retaining a game ball thereon and for selectively releasing the game ball for rolling movement down the ramp.

22. The game as defined in claim 21 wherein each of said retaining and releasing means comprises a lever pivotally mounted on its associated ramp intermediate its ends, said lever having an opening in the end thereof closest to said common station for engaging a portion of a game ball; and resilient means biasing the lever into engagement with the game ball to trap the game ball between the lever and the ramp.

23. The game as defined in claim 22 wherein each of said ramps comprises an upwardly opening channel having a lower surface and said resilient means comprises a cut-out leaf spring formed in said lower surface of the ramp and operatively engaged with said lever.

* * * * *